US005966785A

United States Patent [19]

Catallo

[11] Patent Number: 5,966,785

[45] Date of Patent: Oct. 19, 1999

[54] APPARATUS FOR SOFTENING A FABRIC WEB MATERIAL

[76] Inventor: Frank Catallo, 75 Channel Dr., Port Washington, N.Y. 11050

[21] Appl. No.: 09/075,741

[22] Filed: May 11, 1998

Related U.S. Application Data

[63] Continuation-in-part of application No. 08/994,469, Dec. 19, 1997, abandoned.

[51] Int. Cl.[6] ..... D06C 19/00

[52] U.S. Cl. ..... 26/27; 26/71

[58] Field of Search ..... 26/27, 28, 25, 26/71, 26, 99, 104; 264/290.7, 288.4, 292

[56] References Cited

U.S. PATENT DOCUMENTS

| | | | |
|---|---|---|---|
| 1,376,736 | 5/1921 | Thornber | 26/97 |
| 1,730,520 | 10/1929 | McMurray | 26/27 |
| 3,266,117 | 8/1966 | Sapilevsky | 26/27 |
| 3,363,276 | 1/1968 | Thomas, Jr. | 26/27 |
| 3,408,709 | 11/1968 | Reitz | 26/27 |
| 4,087,226 | 5/1978 | Mercer | 425/397 |
| 4,368,565 | 1/1983 | Schwarz | 26/99 |
| 4,769,879 | 9/1988 | Otto | 26/27 |
| 5,167,054 | 12/1992 | Eschenbach | 26/27 |
| 5,455,992 | 10/1995 | Kurschatke et al. | 26/99 |
| 5,619,779 | 4/1997 | Geyer | 26/97 |

FOREIGN PATENT DOCUMENTS

| | | | |
|---|---|---|---|
| 494033 | 10/1938 | United Kingdom | 26/21 |

*Primary Examiner*—Amy B. Vanatta
*Attorney, Agent, or Firm*—Charles E. Baxley

[57] ABSTRACT

An apparatus for imparting soft hand to a fabric in web form, especially printed knits and non-wovens, by mechanically introducing localized tension in the web. The web is preferably advanced in continuous rubbing engagement with one or more contact members that can be pairs of nip rollers and/or breaker bars. Nip roller pairs include one knobbed roller deformably engaging a soft roller with the web passing therebetween. Breaker bars can have straight, serrated or curvilinear edges and the web can be passed over or under the breaker bars. Various combinations of nip roller pairs and breaker bars are provided for and a variable drive is employed.

44 Claims, 2 Drawing Sheets

FIG. 5
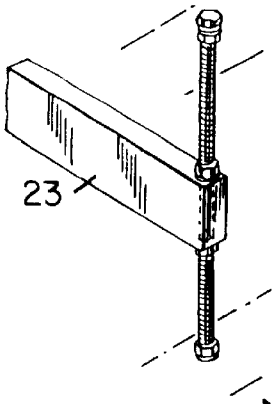
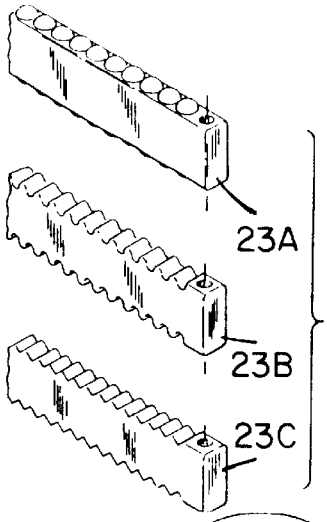
FIG. 6
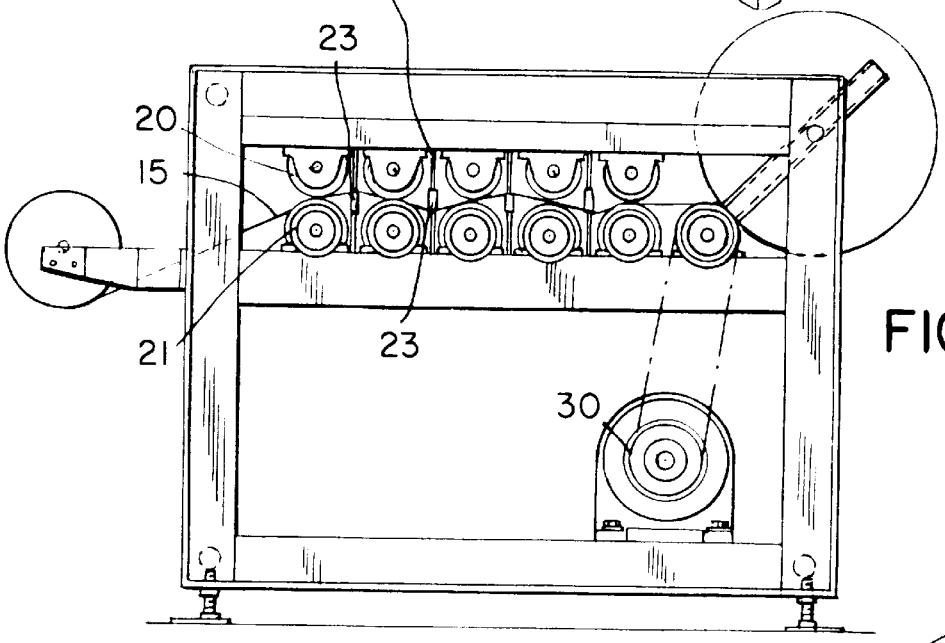
FIG. 1
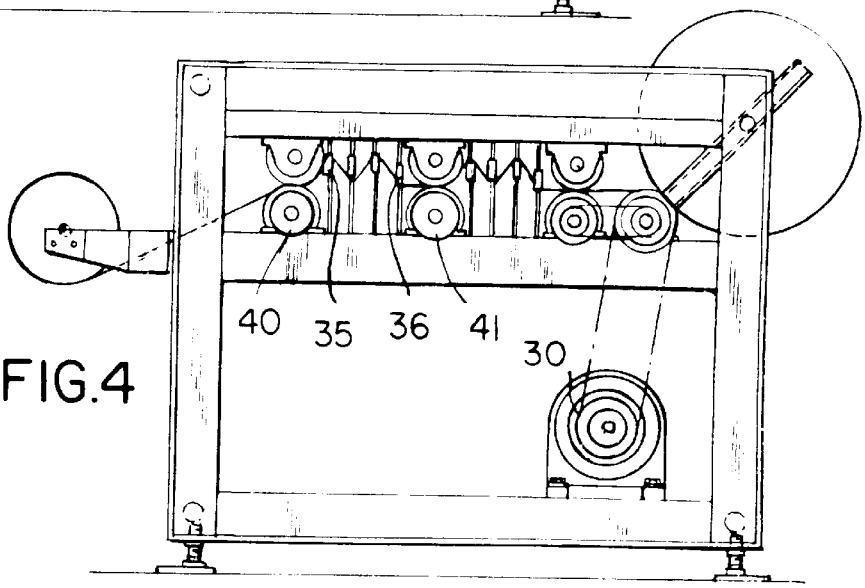
FIG. 4

APPARATUS FOR SOFTENING A FABRIC WEB MATERIAL

CROSS REFERENCE TO RELATED APPLICATION

The present Application is a continuation-in-part Application based on parent application Ser. No. 08/994,469, now abandoned, that had been filed on Dec. 19, 1997.

BACKGROUND OF THE INVENTION

The present invention relates to an apparatus for softening a web material by exerting local tensions at predetermined situses on the web.

Certain types of web materials such as non-wovens and printed knit fabrics generally have a harsh hand or feel. Manufacturers and finishers of these fabrics have tried to soften the fabric and improve its drape by applying chemical treatments, compacting and sometimes washing the web following same by relaxed drying. Chemical treatment is expensive and requires application apparatus plus drying equipment. Compacting increases weight of the material and also its cost. Washing and drying also are expensive.

Printed woven fabrics have been and still are softened by applying longitudinal tension while at the same time passing the material in contact with several rollers that have a button head surface. This procedure causes application of added extreme tension on the material as the buttons protrude into and stretch the fabric to break its printed pigment surface to thereby end up with a softer fabric. A machine of this type is referred to in the art as a Button Breaker. While a Button Breaker works reasonably well on woven fabrics, it distorts other materials such as knits and non-wovens to a degree that substantially destroys them. Usually imposing longitudinal tension on a knitted fabric stretches the fabric and curls or rolls its edges making the fabric undesirable for use.

SUMMARY OF THE INVENTION

It is therefore an object of the present invention to provide apparatus which will function to impart a soft feel or hand to a web material which is very desirable.

Another object of the present invention is to provide apparatus for achieving this soft and desirable hand in an inexpensive and efficient manner.

Another object of the present invention is to soften fabrics, especially printed knits and non-wovens, without applying excessive longitudinal tension thereto.

Another object of the present invention is to provide an inexpensive mechanical apparatus for softening various web materials, especially printed knits, without substantially changing the weight, shape or size of the web and achieving at the same time a soft feel or hand to the web material.

Another object of the present invention is to offer a versatile selection among equipment arrangements and techniques for application to particular needs of various fabric webs to be softened.

Generally speaking, an apparatus according to the present invention comprises a means allowing movement of the web material through the apparatus and while the web is so moving the apparatus imparts localized tension in predetermined locations on the web.

The foregoing and other objects and advantages of the present invention will appear more clearly hereinafter. In accordance with the present invention there is provided an apparatus for softening web materials by exerting localized tension at random situses on the web material.

BRIEF DESCRIPTION OF THE DRAWINGS

Other important objects and advantages of the present invention will be apparent from the following detailed description taken in connection with accompanying drawings wherein like numerals refer to like parts and in which:

FIG. 1 is a side elevational view of an apparatus according to this invention for acting on a web material to soften same;

FIG. 4 is a side elevational view showing another embodiment of the apparatus which likewise permits one to achieve objectives of the present invention;

FIG. 5 is an isolated, enlarged, broken isometric view of a breaker bar from FIG. 1 with a straight edge; and FIG. 6 shows breaker bars with buttons 23A, curvilinear edge 23B and serrations 23C.

DESCRIPTION OF PREFERRED EMBODIMENTS

Figure 2:
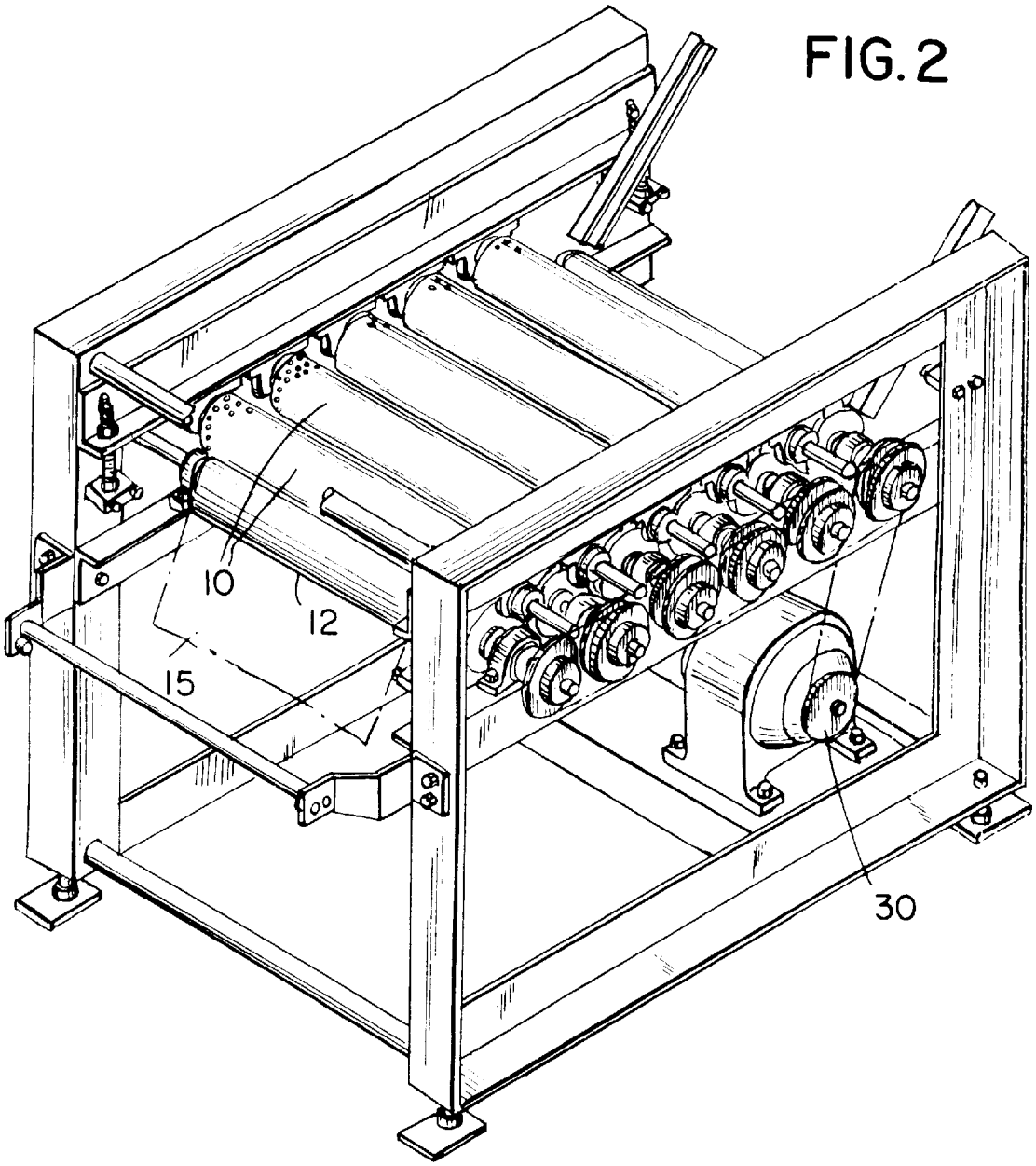
FIG. 2 is a schematic prospective view of another embodiment of the apparatus.

Referring to the drawings, various embodiments for achieving the soft and desirable hand are shown. In FIG. 2, an arrangement is shown comprising a plurality of rollers having an upper knobbed button roller 10 in abutment with a lower rubber or similar roller 12. Knobs of the button roller 10 press into the soft roller 12 and stretch locally and randomly without applying substantial longitudinal tension to a fabric web 15 being processed and soft hand of the fabric web results.

Another form of the apparatus is shown in FIGS. 1, 5 and 6 wherein the fabric 15 passes through upper and lower rolls 20, 21 and over a breaker bar 23 seen more clearly in FIG. 5. That arrangement also increases localized tension. The fabric may be arranged by adjusting the breaker bar 23 as shown in FIG. 4 so that the web runs through a pair of rollers 40 then over the top of one bar 23 and then under the bottom of another bar 23 as is similarly shown in FIG. 1. Also as shown in FIG. 6, edges of the breaker bar 23 can be straight 23, buttoned 23A, serrated 23C, curvilinear 23B or combinations thereof. A variable speed drive 30 is arranged to turn a preselected roller, as shown, which moves the web through one or more pair of rollers 20, 21 and over or under a desired number of breaker bars 23.

Figure 3:
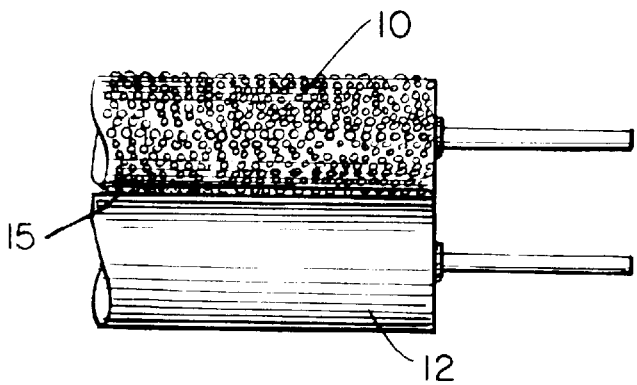
FIG. 3 is a simplified and broken away view of a knobbed roller co-acting with a soft rubber-covered roller.

Various arrangements of locating the web between the breaker bars 23 may be used, as shown in FIGS. 1 and 4, in order to achieve desirable fabric web softening results. Such disposition is shown particularly in FIG. 4, for example, wherein the web material passes through a pair of rollers 40 then continuously over a breaker bar 35 then under a succeeding breaker bar, through another pair of rollers 41, and so on. As will be understood, it is not necessary to run the web both between nip rollers and also over and/or under a breaker bar. A non-woven web sometimes softens considerably by just passing the material continuously over and under one or more of the breaker bars, in which case nip rollers 40, 41 merely control overall web tension. In circumstances depicted in FIG. 3, where an upper knobbed roller 10 is provided, the soft lower rubber roller 12 yields locally to pressing by the knobs 15 and normally has an approximate durometer hardness of about 15.

Having described the present invention in detail, it is obvious that one skilled in the art will be able to make variations and modifications to same without departing from the scope of the invention. Accordingly, the scope of the present invention may be determined from claims which follow.

I claim:

1. An apparatus for imparting soft hand to a web of a fabric material, the apparatus comprising:

a pair of nip rollers through which the web of the fabric is passed;

the pair of nip rollers including one knobbed roller having knobs thereon and a paired relatively soft roller organized to yield locally under pressure of the knobs thereinto.

2. The apparatus of claim 1, with a plurality of the pairs of nip rollers.

3. The apparatus of claim 2, with a variable speed drive arranged to turn a preselected one of the rollers.

4. The apparatus of claim 1, wherein the knobs are provided with an arcuate surface.

5. The apparatus of claim 1, wherein the knobs are irregular in shape.

6. The apparatus of claim 1, wherein the knobs are arranged on the knobbed roller in a decorative pattern that repeats on the web.

7. An apparatus for imparting soft hand to a web of a fabric material having a first side and an opposite second side, the apparatus comprising:

a first physical contact member and a second physical contact member;

means for advancing the web with the first side in continuous rubbing engagement with the first physical contact member and with the second side in continuous rubbing engagement with the second physical contact member;

whereby localized tension is developed in the fabric.

8. The apparatus of claim 7, wherein each of the physical contact members comprises a breaker bar having an edge over which the web of the fabric is passed in continuous rubbing engagement.

9. The apparatus as claimed in claim 7 wherein the means for advancing the web passes the first side of the web in continuous rubbing engagement with the first physical contact member before passing the second side of the web in continuous rubbing engagement with the second physical contact member.

10. The apparatus as claimed in claim 9 wherein at least one of the physical contact members is stationary.

11. The apparatus as claimed in claim 10 wherein both of the physical contact members are stationary.

12. The apparatus as claimed in claim 11 with each of the physical contact members including a straight edge to provide the continuous rubbing engagement with its associated side of the web.

13. The apparatus as claimed in claim 12 with:

each of the physical contact members comprising a breaker bar spaced from the other breaker bar along a general path of travel of the web;

the straight edge of one of the breaker bars arranged in one direction normal to said general path of travel of the web and the straight edge of the other of the breaker bar arranged in an opposite direction also normal to said general path of travel of the web.

14. The apparatus as claimed in claim 11 with:

each of the physical contact members including a serrated edge to provide the continuous rubbing engagement with its associated side of the web;

each of the physical contact members comprising a breaker bar arranged along a general path of travel of the web and each of the breaker bars spaced from the other breaker bar along said general path of travel of the web;

the serrated edge of one of the breaker bars arranged in one direction normal to said general path of travel of the web and the serrated edge of the other of the breaker bars arranged in an opposite direction also normal to said general path of travel of the web.

15. The apparatus as claimed in claim 11 with:

each of the contact members including a curvilinear edge to provide the continuous rubbing engagement with its associated side of the web;

each of the contact members comprising a breaker bar arranged along a general path of travel of the web and each breaker bar spaced from the other of the breaker bars along the general path of travel of the web, the curvilinear edge of one of the breaker bars arranged in one direction normal to said general path of travel of the web and the curvilinear edge of the other one of the break bars arranged in an opposite direction also normal to said general path of travel of the web.

16. The apparatus as claimed in claim 7 wherein:

one of the physical contact means comprises at least one pair of nip rollers, a first breaker bar having a first straight edge and a second breaker bar having a second straight edge, means for passing the web of the fabric through the pair of nip rollers in continuous contact therewith and in series past the breaker bars over one and under the other of the breaker bars in continuous rubbing contact with the straight edge of each of the breaker bars.

17. The apparatus as claimed in claim 7 wherein:

one of the physical contact members comprises at least one pair of nip rollers, the other of the physical contact member comprise a first breaker bar having a first straight edge and a second breaker bar having a second straight edge, means for passing the web of the fabric through the pair of nip rollers in continuous contact therewith and in series past the breaker bars over the first straight edge and under the second straight edge of the breaker bars in continuous rubbing contact with both of the straight edges.

18. An apparatus for imparting soft hand to a web of fabric material, selected from a group consisting of printed knits and non-wovens, the apparatus comprising:

a pair of nip rollers through which the web of the fabric is passed, the pair of nip rollers including one knobbed roller having knobs thereon and a paired relatively soft roller organized to yield locally under pressure of the knobs thereinto.

19. The apparatus of claim 18, with a plurality of the pairs of nip rollers.

20. The apparatus of claim 19, with a variable speed drive arranged to turn a preselected one of the rollers.

21. The apparatus of claim 18, wherein the knobs are provided with an arcuate surface.

22. The apparatus of claim 18, wherein the knobs are irregular in shape.

23. The apparatus of claim 18, wherein the knobs are arranged on the knobbed roller in a decorative pattern that repeats on the web.

24. An apparatus for imparting soft hand web of a fabric material, selected from a group consisting of printed knits and non-wovens, the fabric material having a first side and an opposite second side, the apparatus comprising:

a first physical contact member and a second physical contact member, means for advancing the web with the first side in continuous rubbing engagement with the first physical contact member and with the second side in continuous rubbing engagement with the second physical contact member, whereby localized tension is developed in the fabric.

25. The apparatus of claim 24, wherein each of the physical contact members comprises a breaker bar having an edge over which the web of the fabric is passed in continuous rubbing engagement.

26. The apparatus as claimed in claim 24 wherein the means for advancing the web further passes the first side of the web in continuous rubbing engagement with the first physical contact member before then passing the second side of the web in continuous rubbing engagement with the second physical contact member.

27. The apparatus as claimed in claim 26 wherein at least one of the physical contact members is stationary.

28. The apparatus as claimed in claim 27 wherein both of the physical contact members are stationary.

29. The apparatus as claimed in claim 28 with each of the physical contact members including a straight edge in the continuous rubbing engagement with its associated side of the web.

30. The apparatus as claimed in claim 29 with:

each of the physical contact members comprising a breaker bar spaced from the other breaker bar along a general path of travel of the web;

the straight edge of one of the breaker bars arranged in one direction normal to said general path of travel of the web and the straight edge of the other of the breaker bars arranged in an opposite direction also normal to said general path of travel of the web.

31. The apparatus as claimed in claim 28 with:

each of the physical contact members including a serrated edge in the continuous rubbing engagement with its associated side of the web;

the serrated edge of one of the breaker bars arranged in one direction normal to said general path of travel of the web and the serrated edge of the other of the breaker bars arranged in an opposite direction also normal to said general path of travel of the web.

32. The apparatus as claimed in claim 28 with:

each of the physical contact members including a curvilinear edge in the continuous rubbing engagement with its associated side of the web;

the curvilinear edge of one of the breaker bars arranged in one direction normal to said general path of travel of the web and the curvilinear edge of the other of the breaker bars arranged in an opposite direction also normal to said general path of travel of the web.

33. A method for imparting soft hand to a web of a fabric material, the method comprising steps of:

passing the web through a pair of nip rollers which include one knobbed roller having knobs thereon and a paired relatively soft roller organized to yield locally under pressure of the knobs thereinto;

whereby localized tension is developed in the fabric.

34. The method as claimed in claim 33 and passing the web through a plurality of pairs of the nip rollers.

35. The method as claimed in claim 33 and providing a variable speed drive arranged to turn a preselected one of the rollers.

36. The method as claimed in claim 33 and providing arcuate surfaces on the knobs.

37. The method as claimed in claim 33 and providing irregular shapes to the knobs.

38. The method as claimed in claim 33 and organizing the knobs on the knobbed roller in a pattern to impart to the web a decorative design that repeats thereon.

39. A method for imparting soft hand to a web of a fabric material having a first side and an opposite second side, the method comprising steps of:

providing a first physical contact member and a second physical contact member;

advancing the web with the first side in continuous rubbing engagement with the first physical contact member and with the second side in continuous rubbing engagement with the second physical contact member;

whereby localized tension is developed in the fabric.

40. The method as claimed in claim 39 and arranging the first side of the web to pass in continuous rubbing engagement with the first physical contact member before the second side of the web passes in continuous rubbing engagement with the second physical contact member.

41. The method as claimed in claim 40 and arranging at least one of the physical contact members to be stationary.

42. The method as claimed in claim 41 and arranging both of the physical contact members to be stationary.

43. The method as claimed in claim 42 and providing each of the physical contact members with a straight edge in the continuous rubbing engagement with its associated side of the web.

44. The method as claimed in claim 43 and:

providing a breaker bar at each of the physical contact members, spacing the breaker bars from each other along a general path of travel of the web;

arranging the edge of one of the breaker bars in one direction normal to said general path of travel of the web and the edge of the other breaker bar in an opposite direction also normal to said general path of travel of the web.

* * * * *